United States Patent [19]

Petzi

[11] 4,365,954

[45] Dec. 28, 1982

[54] CONTINUOUS FURNACE FOR FIRING CERAMIC ARTICLES

[75] Inventor: Fritz Petzi, Nuremberg, Fed. Rep. of Germany

[73] Assignee: Ludwig Riedhammer GmbH & Co. KG, Nuremberg, Fed. Rep. of Germany

[21] Appl. No.: 259,693

[22] Filed: May 1, 1981

[30] Foreign Application Priority Data

May 2, 1980 [DE] Fed. Rep. of Germany ..... 3016852

[51] Int. Cl.[3] ..... F27B 5/04; F27B 9/04; F27B 7/00

[52] U.S. Cl. ..... 432/198; 34/36; 432/23; 432/37; 432/194; 432/201

[58] Field of Search ..... 432/23, 37, 137, 194, 432/198, 201, 202; 34/36

[56] References Cited

U.S. PATENT DOCUMENTS

| | | | |
|---|---|---|---|
| 356,287 | 1/1887 | Mc Ginnis | 432/194 |
| 1,040,895 | 10/1912 | Cowles | 432/137 |
| 3,388,439 | 6/1968 | Tomkins | 432/137 |
| 4,238,122 | 12/1980 | Snyder et al. | 432/23 |

FOREIGN PATENT DOCUMENTS

| | | |
|---|---|---|
| 1508491 | 10/1969 | Fed. Rep. of Germany . |
| 1508478 | 9/1971 | Fed. Rep. of Germany . |
| 1508514 | 3/1973 | Fed. Rep. of Germany . |
| 2428090 | 8/1976 | Fed. Rep. of Germany . |

*Primary Examiner*—John J. Camby
*Attorney, Agent, or Firm*—Spencer & Kaye

[57] ABSTRACT

A continuous electric tunnel furnace includes a tunnel through which articles to be fired are passed in a direction of feed. The tunnel has a length portion constituting a sintering zone. Nitrogen is introduced into the tunnel at the outlet thereof. The nitrogen stream is oriented against the direction of feed. There is further provided a gate projecting from the tunnel roof into the tunnel in the sintering zone in an orientation transverse to the direction of feed. The gate has opposite lateral bounding edges which are spaced from respective side walls of the tunnel.

6 Claims, 4 Drawing Figures

NITROGEN
REGULATOR
31
temperature diagram
ideal $O_2$ diagram in % $O_2$
% $O_2$
°C x100
temperature
M
M'

CONTINUOUS FURNACE FOR FIRING CERAMIC ARTICLES

BACKGROUND OF THE INVENTION

This invention relates to a continuous electric tunnel furnace of rectangular tunnel cross section. The electric heating elements of the furnace are generally arranged under the tunnel roof. The furnace further comprises an arrangement which blows a nitrogen jet from the tunnel outlet in a direction opposite to the direction of advance of the articles to be fired, particularly ceramic components for electronic equipment.

In continuous tunnel furnaces of the above-outlined type, the green ceramic articles are positioned on slide plates which are advanced continuously through the tunnel furnace and thus the articles are fired in the tunnel during their continuous advance therethrough. Instead of sliding plates, carriages, sleds or the like may be used as carriers for feeding the articles through the tunnel.

In tunnel furnaces of the above-outlined type it is of great importance to ensure, in all furnace zones along the length of the tunnel, a temperature distribution which at every location along the tunnel length is uniform throughout the entire tunnel cross section. The furnace temperature at the furnace inlet is practically identical to the environmental temperature and amounts to, for example, 20° C. In the subsequent heating zone (heat-up zone), the furnace temperature slowly and continuously increases to the sintering temperature of, for example, 1300°–1500° C. This sintering temperature is maintained in the entire sintering zone (high-temperature zone) which is downstream of the heat-up zone (as viewed in the direction of article advance through the furnace). Downstream of the sintering zone the cooling zone begins in which the temperature is continuously decreased to the furnace outlet. At the furnace outlet the furnace temperature is, for example, approximately 100° C.

Similarly to the above-noted desired uniform temperature distribution over any given tunnel cross section, it is important that a uniform furnace atmosphere prevail throughout the entire tunnel cross section at a given location along the tunnel length. The furnace atmosphere is formed of an oxygen-nitrogen mixture. The oxygen-nitrogen ratio at the furnace inlet corresponds to that of the environmental atmosphere. Progressing through the furnace, the oxygen proportion is decreased by introducing nitrogen or other protective gas (since the furnace is heated electrically, no oxygen consumption by the heater occurs). In the sintering zone the oxygen content in the furnace atmosphere is lowered to approximately 2 to 10%. From the beginning of the cooling zone the oxygen content must be less than 0.01%, that is, in the cooling zone the oxygen has to be practically entirely eliminated from the furnace atmosphere. This is effected by blowing nitrogen into the tunnel outlet in a direction which opposes the direction of advance of the articles through the furnace.

The introduction of a nitrogen jet into the cooling zone has, in conventional tunnel furnaces, the following effects on the articles passing through the sintering zone:

The articles positioned on sliding plates or the like extend close to the side walls of the tunnel but have, as a rule, a greater distance from the tunnel roof; one reason being that between the tunnel roof and the articles there are positioned components of the electric heater. The free height depends from the structural height of the articles. At the height level of the articles, the nitrogen stream has, as a rule, a smaller flow velocity in the vicinity of the lateral tunnel walls than in the central area of the tunnel cross section. The reason for this phenomenon is the deceleration effect of the friction between the side walls of the tunnel and the nitrogen flow. The leading (front) flow pattern of the nitrogen therefore has, at the height level of the articles, as viewed over the width of the tunnel, the shape of a parabola bulging substantially in the direction opposite to that of article feed. This means that in the sintering zone in the central cross-sectional area portion of the tunnel the oxygen content of the furnace atmosphere is, because of the above-described non-uniform cross-sectional distribution of the nitrogen jet, reduced to a greater extent than in the two lateral cross-sectional area portions flanking the central area portion. Thus, in the sintering zone the oxygen-nitrogen ratio is not uniform over the entire furnace cross section at the individual points along the path of article feed. This circumstance adversely affects the uniformity of the quality of the fired articles.

SUMMARY OF THE INVENTION

It is an object of the invention to provide an improved continuous furnace of the above-outlined type in which, particularly along the length of the sintering zone, there is ensured a more uniform oxygen-nitrogen distribution over the tunnel cross section.

This object and others to become apparent as the specification progresses, are accomplished by the invention, according to which, briefly stated, in the sintering zone of the tunnel furnace there is provided at least one gate extending from the tunnel roof into the inner space of the tunnel in a plane that is perpendicular to the direction of article feed. The gate has lateral edges which are spaced from the side walls of the tunnel.

The arrangement according to the invention provides that the nitrogen flow is braked by the gate in the mid-portion of the tunnel cross section to a similar extent as occurs inherently in the lateral cross-sectional portions of the tunnel because of the braking effect of the tunnel side walls. As a result, dependent upon the distance of the lower edge of the gate from the contour of the articles, the parabola-shaped leading edge of the nitrogen flow is "pushed in", flattened or even somewhat reversed to bulge in the direction of article feed. The lateral edges of the gate are to be maintained at a distance from the tunnel walls because in the upper corner zones of the tunnel cross section there is exerted, from the direction of the lateral walls, a sufficient braking effect on the nitrogen flow.

According to a further feature of the invention, there are provided a plurality of gates distributed over the length of the sintering zone. The result of this arrangement is an equalization of the braking effect for the entire sintering zone.

According to a further feature of the invention, the height position of the gates, that is, the height level of the lower horizontal gate edge is adjustable. This arrangement provides that the gate can be adjusted as a function of the height of the articles or to reduce (brake) the velocity of the nitrogen flow to a desired degree in the central area of the tunnel cross section.

According to a further feature of the invention, the height adjustment of the gate is controlled as a function of signals emitted by an oxygen sensor extending into the furnace tunnel.

The invention may be advantageously incorporated in a continuous tunnel furnace of the type disclosed in German Laid-Open Application (Offenlegungsschrift) No. 1,508,514. The continuous tunnel furnace described therein includes a plurality of screening plates which extend into the wall structure of the furnace in an orientation perpendicular to the direction of article feed. The screening plates, which are stationarily embedded into the furnace wall, each have an aperture corresponding to and being aligned with the full cross-sectional outline of the tunnel. The purpose of the screening plates is to prevent the furnace atmosphere from flowing within the otherwise porous wall structure to thus prevent an atmosphere equalization among the various furnace zones along the length of the tunnel.

DESCRIPTION OF THE PREFERRED EMBODIMENT

Figures 1, 3:
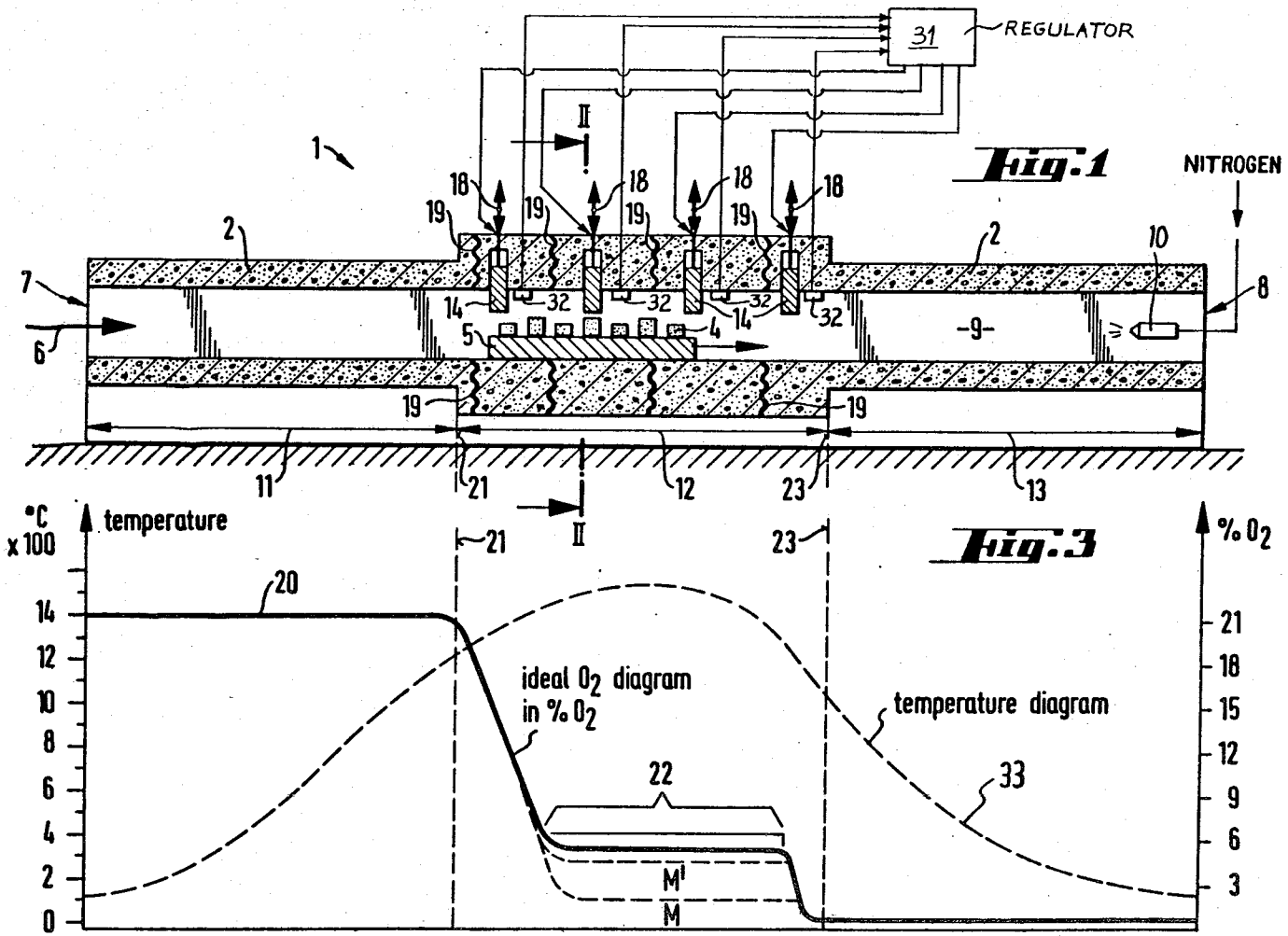
FIG. 1 is a schematic longitudinal sectional view of a continuous tunnel furnace incorporating a preferred embodiment of the invention.
FIG. 3 is a diagram illustrating temperature and the average oxygen content of the furnace atmosphere along the feed path of the furnace tunnel.
Figure 2:
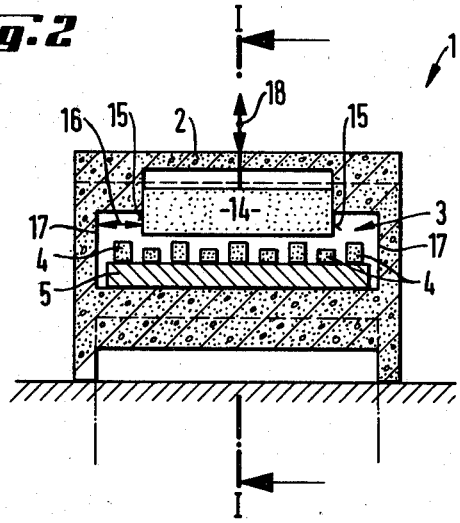
FIG. 2 is a schematic sectional view taken along line II—II of FIG. 1.

Turning to FIGS. 1 and 2, there is shown a continuous electric tunnel furnace generally indicated at 1. The tunnel 9 through which the articles 4 to be fired (for example, ceramic components for electronic equipment) are passed and which has a rectangular cross section 3, is conventionally heated by electric heating elements (not shown) situated particularly underneath the tunnel roof 2. The articles 4 are positioned on conveyor plates 5 advanced in the feed direction 6 from the input side 7 to the output side 8 of the tunnel 9. For controlling the oxygen distribution in the tunnel 9 nitrogen is introduced by a conventional nozzle device 10 such that the nitrogen stream emitted by the device 10 opposes the article feeding direction 6.

Starting from the tunnel inlet 7, the articles 4 first pass through the heat-up zone 11, then proceed through the sintering zone 12 and are then conveyed through the cooling zone 13.

In the sintering zone 12 of the tunnel furnace 1 there is provided at least one gate 14 which is arranged transversely to the feed direction 6 and which may be vertically slidably introduced into the tunnel 9 from the tunnel roof 2. The lateral vertical edges 15 of the gate 14 are situated at a distance 16 from the respective vertical side walls 17 of the tunnel. It is noted that in defining "vertical" orientations, there is assumed a substantially horizontal feed direction 6. As a dimensional example it is noted that for a given square cross section 3 of the tunnel 9, wherein the cross-sectional sides are 350 mm each, the distance 16 of each lateral edge 15 from the respective adjacent side wall 17 is advantageously 50 mm, resulting in a width of 250 mm for the gate 14.

Preferably a plurality of gates 14 are uniformly distributed along the length of the sintering zone 12. The space to be occupied by the gates is rectangular, similarly to the entire tunnel cross section. The individual gates 14 are height-adjustable as indicated by the arrows 18.

The height of the gates 14 is adjusted by a regulator 31 in response to signals applied thereto by oxygen sensors 32 projecting into the tunnel 9 and distributed along the sintering zone 12 to be associated with respective gates 14. The signals from the respective oxygen sensors 32 are applied to the regulator 31 which, in a conventional manner by itself, causes a lowering or raising of the respective gates 14 as a function of the signals emitted by the associated oxygen sensor 32.

Diffusion screens 19, corresponding in structure and function to the screening plates disclosed in the earlier-discussed German Laid-Open Application No. 1,508,514 are held in the furnace wall along the sintering zone 12.

By blowing nitrogen from the nozzle 10 and conceivably also from the sides 17 and the roof 2 of the tunnel 9 into the sintering zone 12, the $O_2$ content of the furnace atmosphere assumes a course along the tunnel length as illustrated by the curve 20 shown in FIG. 3. It is seen that within the cooling zone 13 practically no $O_2$ is present and thus the cooling zone is practically fully filled by nitrogen. A more detailed configuration of the nitrogen flow is therefore of no significance as concerns the nitrogen distribution in the cooling zone 13.

The conditions, however, are different in the sintering zone 12 where the $O_2$ content of the furnace atmosphere steeply decreases from the beginning 21 of the sintering zone 12 and then remains substantially constant throughout a major length portion 22 of the sintering zone 12. Thereafter the $O_2$ content steeply drops again to the end 23 of the sintering zone 12 (which coincides with the inlet of the cooling zone 13). Within the sintering zone 12 the $O_2$ content of the furnace atmosphere has, without the presence of a gate 14, a distribution at the height level of the articles 4 along the width of the tunnel 9 as illustrated by the dash-dotted curve 25 of FIG. 4. Because of the nitrogen flow braked in the zone of the lateral walls 17, there the oxygen content is higher than in the cross-sectional mid-zone 26. The curve 25 is a parabola, its maximum is approximately in the middle of the cross-sectional mid-zone 26.

Figure 4:
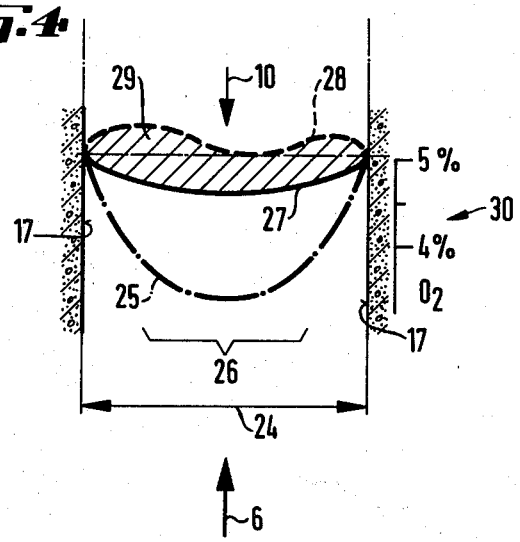
FIG. 4 is a schematic diagram illustrating the oxygen content of the furnace atmosphere distributed over the tunnel width in the sintering zone, approximately at the height level of the articles.

By positioning the gate 14 in the tunnel 9 as shown in FIGS. 1 and 2, the mid-portion 26 of the curve 25 is flattened to a certain degree as illustrated by the solid-line curve 27 of FIG. 4. By further lowering the gate 14, the curve of the oxygen content of the furnace atmosphere—distributed over the oven width 24—may even assume a negative course as indicated by the dashed curve 28. The shaded area 29 defined between the curves 27 and 28 shows the range within which the oxygen-nitrogen distribution may vary over the tunnel width 24 at a given location along the feed path.

FIG. 4 thus shows that the variation range or, as the case may be, the tolerance range over the width 24 is significantly narrowed when compared with a furnace which is not equipped with the gate 14 of the invention.

It is noted that the temperature conditions along the tunnel are indicated by the dashed curve 33 in FIG. 3.

While the scale 30 pertaining to FIG. 4 is provided with percentage calibration, these values are to be interpreted as being only of qualitative nature since their relevance depends from the particular location along the feed path where the oxygen-nitrogen distribution is measured.

The dotted lines M and M' in FIG. 3 indicate other possible levels of oxygen content in the length portion 22 of the sintering zone 12.

It will be understood that the above description of the present invention is susceptible to various modifications, changes and adaptations and the same are intended to be comprehended within the meaning and range of equivalents of the appended claims.

What is claimed is:

1. In a continuous electric tunnel furnace including a tunnel through which articles to be fired are passed in a direction of feed; said tunnel having an inlet and an outlet at opposite longitudinal ends thereof and a roof and opposite side walls; said tunnel further including a length portion constituting a sintering zone; and means for generating a nitrogen stream in the zone of said outlet and for orienting the nitrogen stream against said direction of feed; the improvement comprising a plurality of gates projecting from said roof into said tunnel in said sintering zone in an orientation transverse to said direction of feed; said gates being distributed over the length of said sintering zone; each gate being height-adjustable and having opposite lateral bounding edges being spaced from said side walls; further comprising regulating means for individually adjusting the height position of each said gate; said regulating means comprising a plurality of oxygen sensors situated in said sintering zone and distributed over the length thereof; each said oxygen sensor being associated with a different said gate; and a regulator connected with said oxygen sensors for receiving signals therefrom; said regulator being further connected to said gates for individually setting the height position of each said gate as a function of the signals from the oxygen sensor associated with the respective gate.

2. A continuous electric tunnel furnace as defined in claim 1, wherein said tunnel has a rectangular cross section and wherein the tunnel area taken up by said gates is rectangular.

3. In a continuous electric tunnel furnace including a tunnel through which articles to be fired are passed in a direction of feed; said tunnel having an inlet and an outlet at opposite longitudinal ends thereof and a roof and opposite side walls; said tunnel further including a length portion constituting a sintering zone; and means for generating a nitrogen stream in the zone of said outlet and for orienting the nitrogen stream against said direction of feed; the improvement comprising a gate projecting from said roof into said tunnel in said sintering zone in an orientation transverse to said direction of feed; said gate being slidable in a direction towards or away from said roof and having opposite lateral bounding edges being spaced from said side walls; further comprising setting means for adjusting the height position of said gate; said setting means including regulating means for adjusting the height position of said gate as a function of the oxygen content of the furnace atmosphere in said sintering zone.

4. A continuous electric tunnel furnace as defined in claim 3, wherein said tunnel has a rectangular cross section and wherein the tunnel area taken up by said gate is rectangular.

5. A continuous electric tunnel furnace as defined in claim 1 or 3, wherein said tunnel has a rectangular cross section.

6. A continuous electric tunnel furnace as defined in claim 3, wherein said regulating means comprises an oxygen sensor situated in said sintering zone and a regulator being connected with said oxygen sensor for receiving signals therefrom; said regulator being further connected to said gate for setting the height position thereof as a function of said signals.

* * * * *